US009161599B1

(12) United States Patent
Shelton

(10) Patent No.: US 9,161,599 B1
(45) Date of Patent: Oct. 20, 2015

(54) HAT CASE ASSEMBLY

(71) Applicant: Daniel Shelton, Gum Spring, VA (US)

(72) Inventor: Daniel Shelton, Gum Spring, VA (US)

( * ) Notice: Subject to any disclaimer, the term of this patent is extended or adjusted under 35 U.S.C. 154(b) by 0 days.

(21) Appl. No.: 13/943,008

(22) Filed: Jul. 16, 2013

(51) Int. Cl.
*A45C 11/02* (2006.01)
*A45C 5/06* (2006.01)

(52) U.S. Cl.
CPC .. *A45C 11/02* (2013.01); *A45C 5/06* (2013.01)

(58) Field of Classification Search
CPC ..... A45C 5/06; A45C 11/02; A45C 13/02; B65D 25/06
USPC ..... 190/13 R, 13 G, 109, 110; 206/8, 9; 223/84
See application file for complete search history.

(56) References Cited

U.S. PATENT DOCUMENTS

| | | | | | |
|---|---|---|---|---|---|
| 776,284 | A | * | 11/1904 | Wright | 211/33 |
| 798,351 | A | * | 8/1905 | Iarock | 206/8 |
| 961,418 | A | * | 6/1910 | Lloud | 223/25 |
| 1,569,142 | A | * | 1/1926 | Rippetoe | 190/110 |
| 1,636,702 | A | * | 7/1927 | Meyer | 190/13 G |
| 2,028,247 | A | * | 1/1936 | Ritter, Jr. | 206/8 |
| D152,653 | S | * | 2/1949 | Rinehart | D3/284 |
| 2,559,699 | A | | 7/1951 | Bard et al. | |
| 2,693,275 | A | | 11/1954 | Smith | |
| 2,839,217 | A | | 6/1958 | Trudeau | |
| 3,008,568 | A | * | 11/1961 | Van Doren | 206/8 |
| 4,011,973 | A | * | 3/1977 | Leach | 223/84 |
| 4,739,909 | A | * | 4/1988 | Bury | 223/15 |
| 4,881,637 | A | | 11/1989 | Peters et al. | |
| 5,022,515 | A | | 6/1991 | Agostine | |
| 5,074,410 | A | | 12/1991 | Fries et al. | |
| 5,094,369 | A | * | 3/1992 | Thompson | 223/25 |
| D344,233 | S | | 2/1994 | Peters | |
| 5,480,023 | A | | 1/1996 | Puller | |
| D381,197 | S | | 7/1997 | Green et al. | |
| 5,823,328 | A | * | 10/1998 | Fomby | 206/8 |
| 5,988,476 | A | * | 11/1999 | Olerio | 224/630 |
| 6,125,997 | A | | 10/2000 | Campbell | |
| 6,533,152 | B1 | * | 3/2003 | Dischler | 224/413 |
| 7,334,684 | B1 | * | 2/2008 | Fontanilla et al. | 206/541 |
| 2006/0145438 | A1 | * | 7/2006 | Plummer | 280/47.26 |
| 2008/0110711 | A1 | * | 5/2008 | Coughlin | 190/9 |

* cited by examiner

*Primary Examiner* — Sue A Weaver

(57) ABSTRACT

A hat case assembly for protecting a hat while traveling includes a housing that has a bottom wall and a perimeter wall is attached to and extends upwardly from the bottom wall. A cover is pivotally coupled to the perimeter wall of the housing. The cover is positioned in an open position exposing an interior of the housing or in a closed position covering the interior of the housing. A mount is positioned within the housing and is mounted on an interior surface of the bottom wall. The mount is configured to releasably engage a hat and retain the hat on the bottom wall.

1 Claim, 6 Drawing Sheets

HAT CASE ASSEMBLY

BACKGROUND OF THE DISCLOSURE

Field of the Disclosure

The disclosure relates to hat storage and transporting devices and more particularly pertains to a new hat storage and transporting device for protecting a hat during the storage and transportation thereof.

SUMMARY OF THE DISCLOSURE

An embodiment of the disclosure meets the needs presented above by generally comprising a housing that has a bottom wall and a perimeter wall is attached to and extends upwardly from the bottom wall. A cover is pivotally coupled to the perimeter wall of the housing. The cover is positioned in an open position exposing an interior of the housing or in a closed position covering the interior of the housing. A mount is positioned within the housing and is mounted on an interior surface of the bottom wall. The mount is configured to releasably engage a hat and retain the hat cn the bottom wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
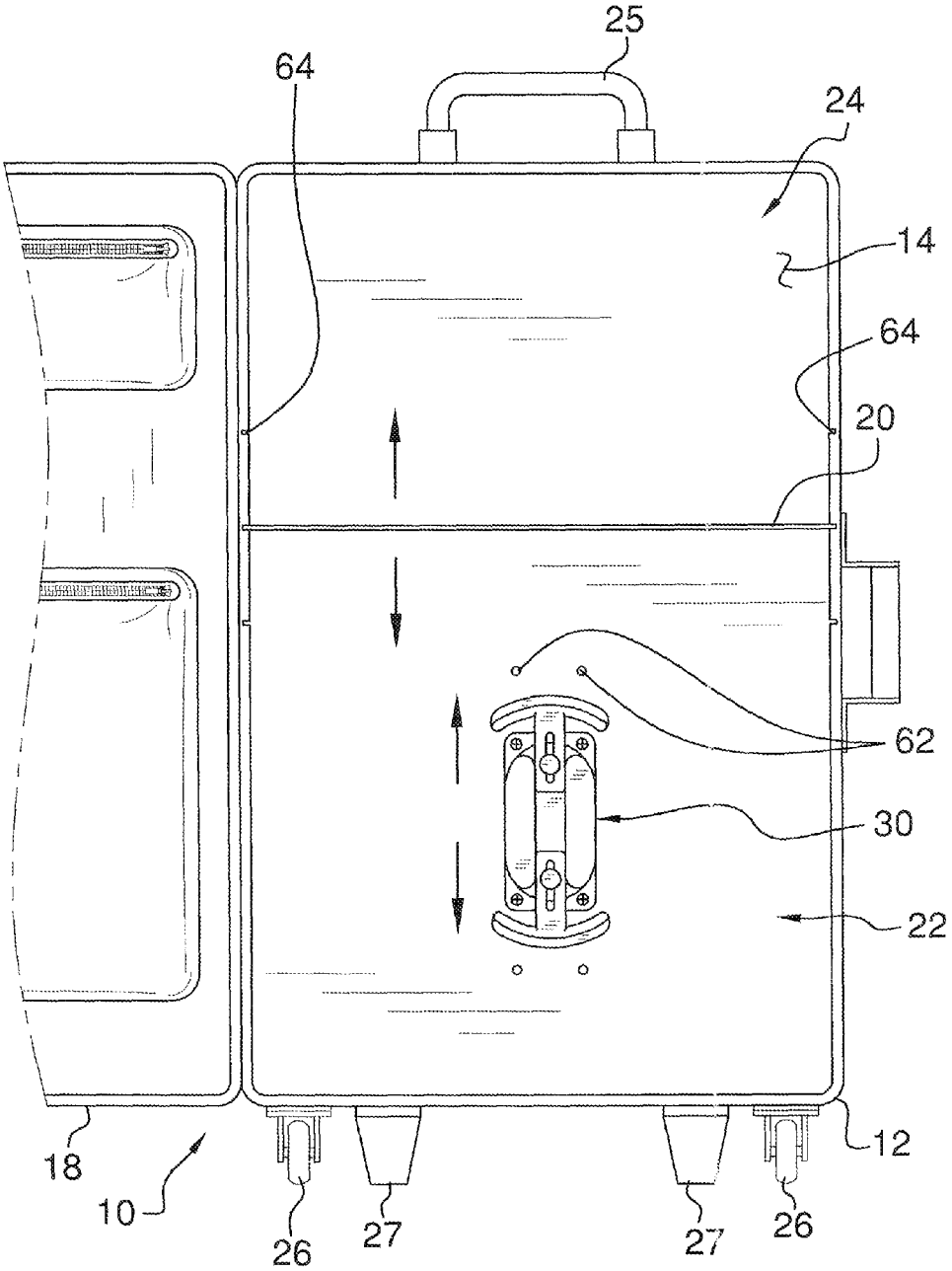
FIG. 1 is a top broken view of a hat case assembly according to an embodiment of the disclosure.
Figure 2:
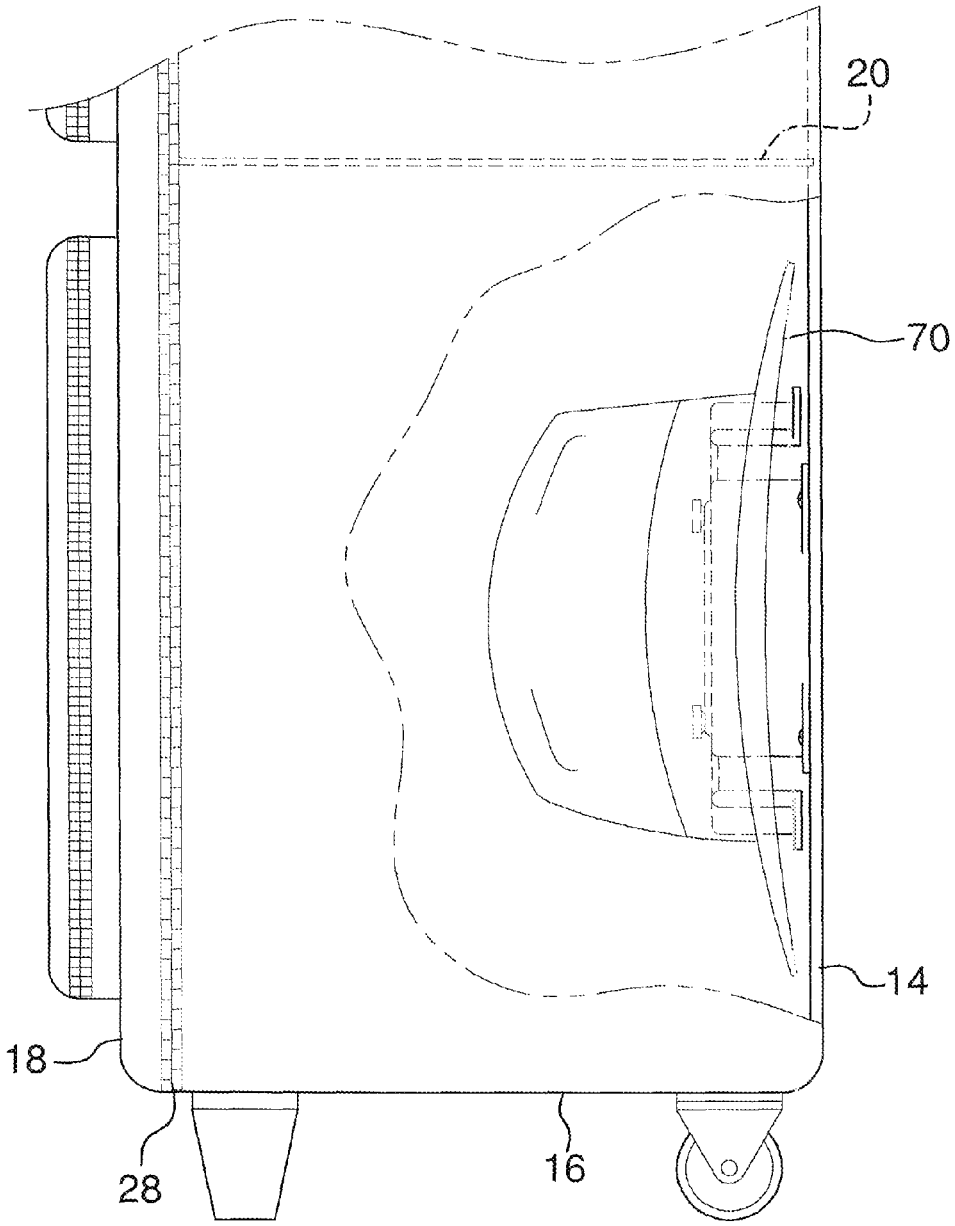
FIG. 2 is a side broken view of an embodiment of the disclosure.
Figure 3:
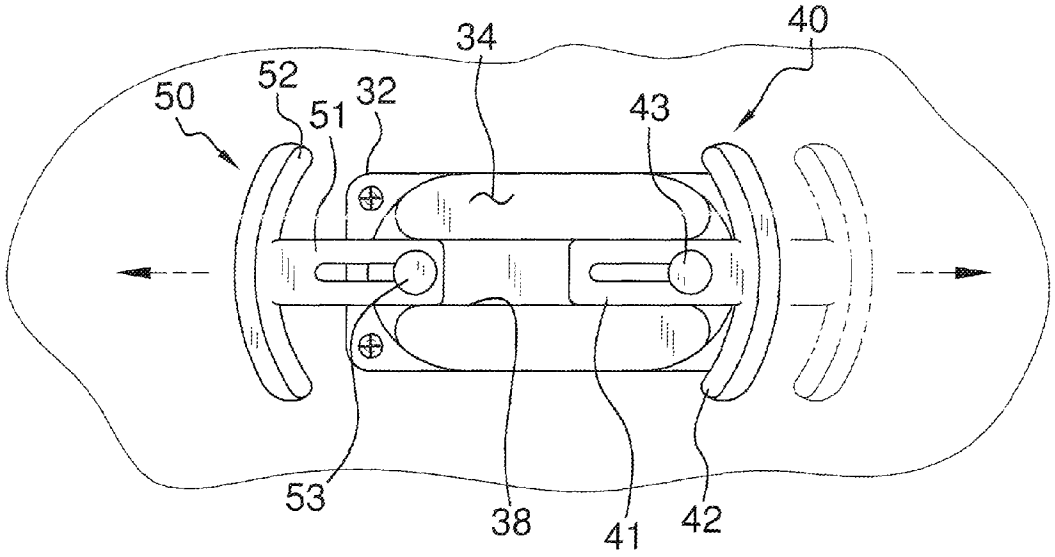
FIG. 3 is a top broken view of an embodiment of the disclosure.
Figure 4:
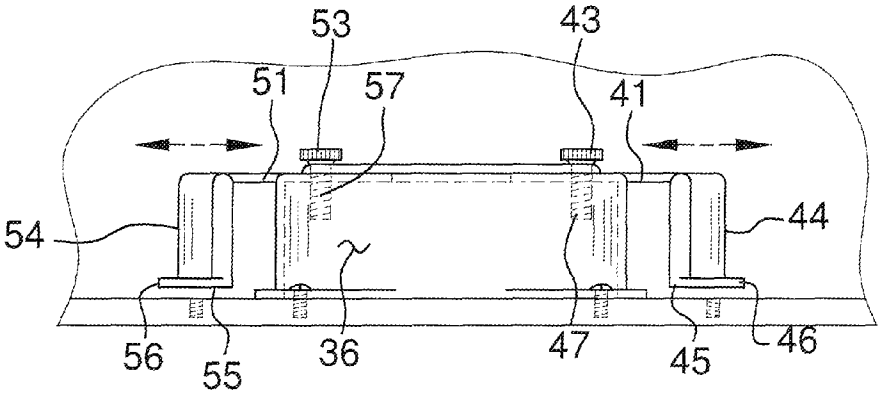
FIG. 4 is a side broken view of an embodiment of the disclosure.

With reference now to the drawings, and in particular to FIGS. 1 through 7 thereof, a new hat storage and transporting device embodying the principles and concepts of an embodiment of the disclosure and generally designated by the reference numeral 10 will be described.

As best illustrated in FIGS. 1 through 7, the hat case assembly 10 generally comprises a housing 12 that has a bottom wall 14 and a perimeter wall 16 is attached to and extending upwardly from the bottom wall 14. A cover 18 is pivotally coupled to the perimeter wall 16 of the housing either by a hinge or by flexible material such as is typically used with a suitcase. The cover 18 is positioned in an open position exposing an interior of the housing 12 or in a closed position covering the interior of the housing 12. The housing 12 may include a divider 20 therein to divide the housing into a first section 22 and a second section 24. As can be seen in FIG. 1, the perimeter wall 16 may include slots for receiving the divider 20 and different sets of slots 64 may be provided to allow the divider to be moved within the housing 12 to alter the size of the first section 22 and second section 24 and may further allow for the additional dividers 20 to be added to the housing 12. For reasons which will become clear, the first section 22 may be for a hat 70 while the second section 24 may be used for conventional articles carried in luggage such as clothing and the like. For this reason, the housing 12 may comprise a conventional suit-case design and include a handle 25, wheels 26, feet 27 and the like. The cover 18 may be held in a closed position with a zipper 28 or other conventional fastener. The cover 18 may further include zippered compartments 58 on its inside surface and outside surface.

Figure 5:
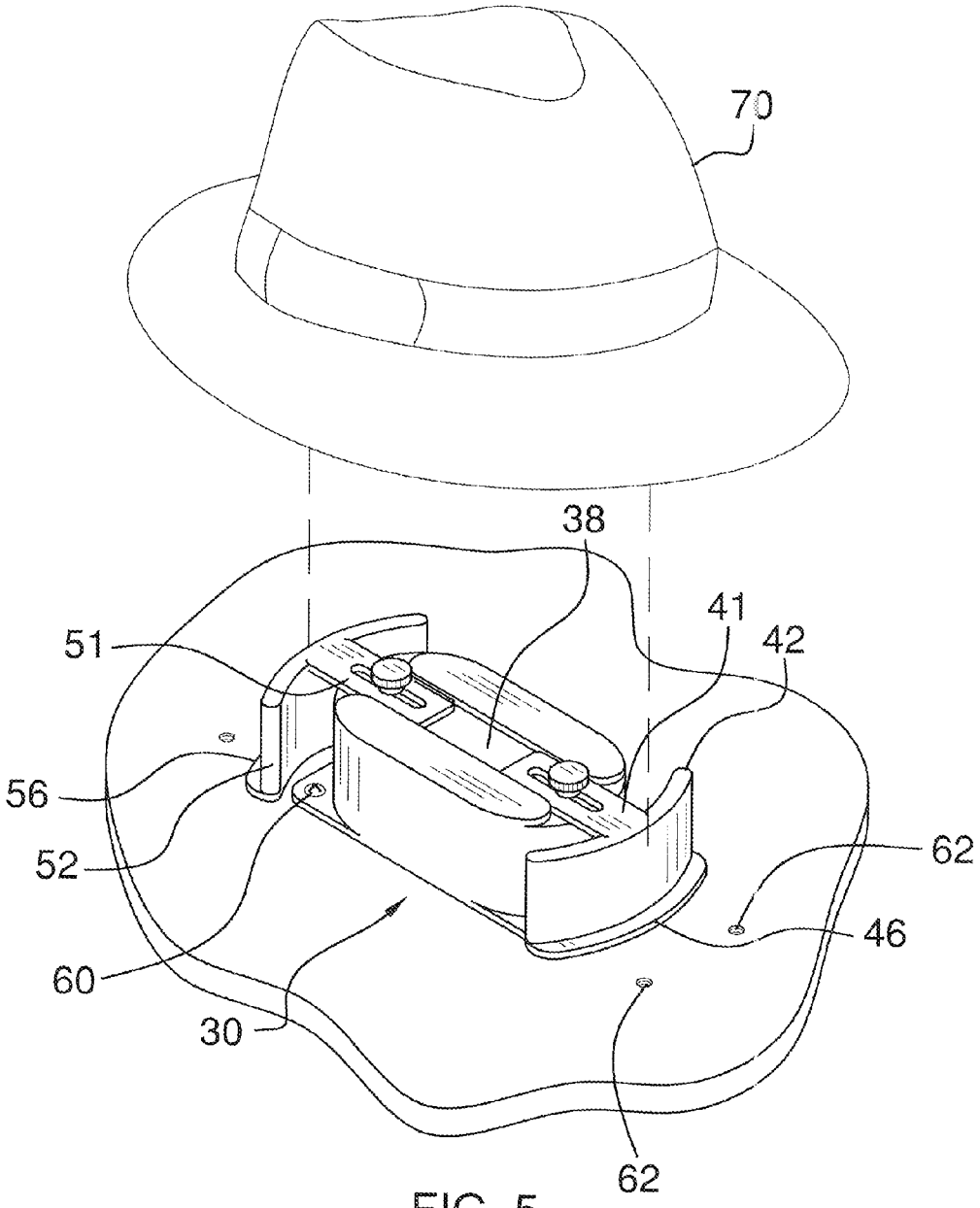
FIG. 5 is a perspective broken view of an embodiment of the disclosure.
Figure 6:
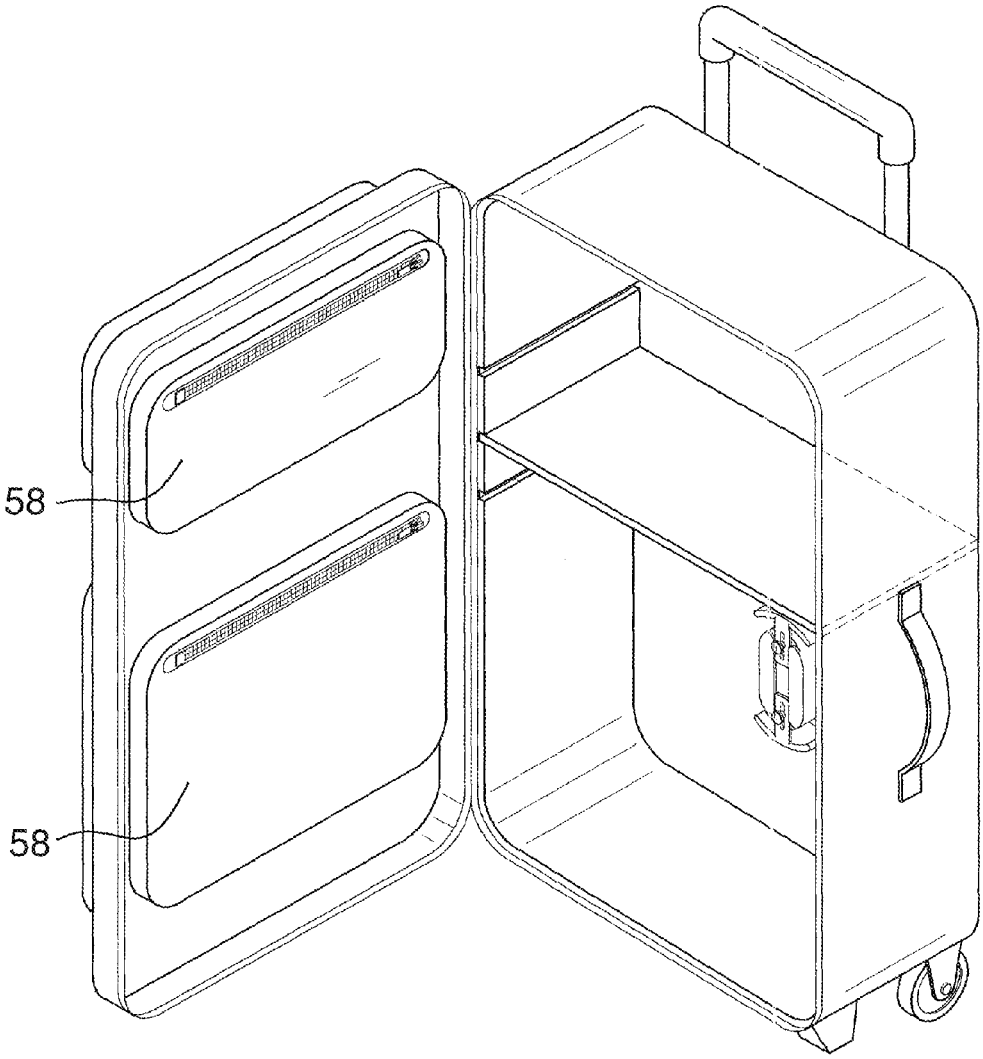
FIG. 6 is a front perspective view of an embodiment of the disclosure.
Figure 7:
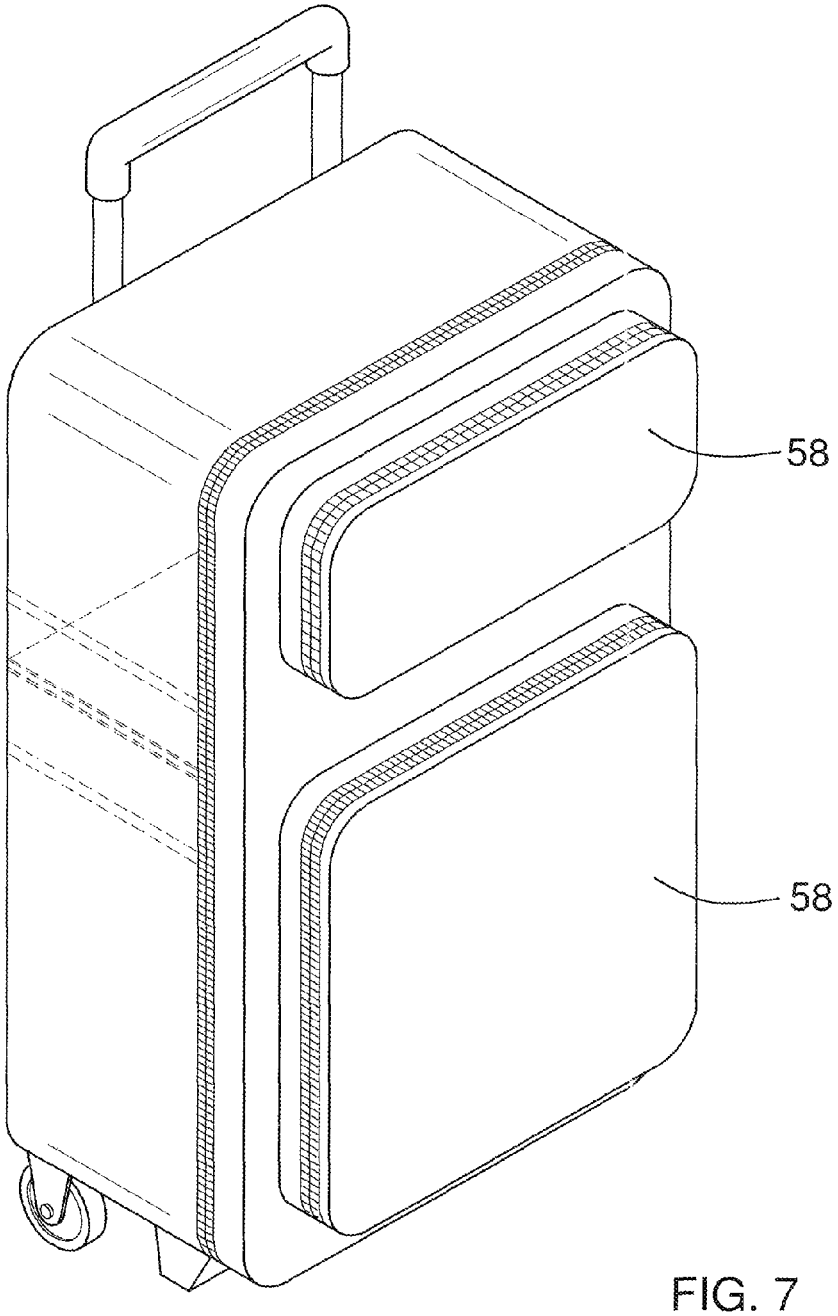
FIG. 7 is a front perspective view of an embodiment of the disclosure.

A mount 30 is positioned within the housing 12 and is mounted on an interior surface of the bottom wall 14 within the first section 22, if the dividing wall 20 is included. The mount 30 is configured to releasably engage the hat 70 and retain the hat 70 on the bottom wall 14. More particularly, the hat 70 is positioned such that it receives the mount 30 and so that the mount 30 may abut and frictionally an inside of the hat 70. The mount 30 includes a base 32 attached to the interior surface of the bottom wall 14. As can be seen in the Figures, the base 32 is attached to the housing 12 with conventional fasteners 60 extending through holes 62 in the bottom wall 14 and the bottom wall 14 may include additional holes 62, shown in FIG. 1 for instance, to allow the base 32 to be repositioned within the housing 12. It should be understood that this may only be one way of having the base 32 be repositionable on the bottom wall 14. The ability to move the mount 30 will allow the user to accommodate variable sized hats in an efficient manner. Moreover, by using fasteners, the user of the assembly 10 will have the option to completely remove the mount 30 from the housing 12. The base 32 has an upper surface 34 and a perimeter surface 36. A primary bracket 40 is mounted on the base 32 and is selectively extendable outwardly away from the perimeter surface 36 to engage the hat 70 when the mount 30, or base 32, is extended into the hat 70. A locking member 43 releasably locks the primary bracket 40 in a selected position. The primary bracket 40 may include a first arm 41 and a second arm 42 attached to each other. The first arm 41 is slidably coupled to the base 32 and is slidable in a plane oriented parallel to the bottom wall 14. The first arm 41 may be positioned on the upper surface 34 within a channel 38 as shown in FIG. 5. The second arm 42 is vertically oriented with respect to the bottom wall 14. The second arm 42 has an outer face 44 facing away from the base 32 which is convexly arcuate to match the contours of the inside of the hat 70. The second arm 42 has a proximal edge 45 with respect to the bottom wall 14. A lip 46 is attached to the proximal edge 45 to prevent the hat 70 from moving below the proximal edge 45 where the proximal edge 45 could damage or misshape the hat 70. The locking member 43 may be positioned to engage the first arm 41 and may more particularly include a knob threadably coupled to the base by a threaded rod 47 and urged against the first arm 41 when tightened into the base 32.

A secondary bracket 50 may also be mounted on the base 32. The secondary bracket 50 is selectively extendable outwardly away from the perimeter surface 36 to engage the hat 70 in a direction opposite of the primary bracket 40. A securing member 53 releasably locks the secondary bracket 50 in a selected position. The secondary bracket 50 includes a first leg 51 and a second leg 52 attached to each other. The first leg 51 is slidably coupled to the base 32 and is slidable in a plane oriented parallel to the bottom wall 14. The first leg 51 may be positioned in the channel 38 in the upper surface 34 and the securing member 53 may also comprise a knob threadably coupled to the base 32. The second leg 52 is vertically oriented with respect to the bottom wall 14. The second leg 52 has an exterior face 54 facing away from the base 32. For the same reasons as that the outer face 44 is convex, the exterior face 54 is also convexly arcuate. The second leg 52 has an adjacent edge 55 with respect to the bottom wall 14 and a flange 56 may be attached to the adjacent edge 55 to also protect the hat 70 as does the lip 46. The securing member 53 includes a threaded rod 57 extending through the first leg 51 and into the base 32.

In use, the user places the primary bracket 40, and the secondary bracket 50 if desired, at a selected extension distance from the base 32. The first 40 and second 50 brackets are then secured into place and the hat 70 positioned on the base 32 and the first 40 and second 50 brackets. The second arm 42 and second leg 52 frictionally engage the hat 70 to prevent it from moving within the housing 12 during traveling. This will protect the hat 70 from damage during traveling or storage while the first 40 and second 50 brackets also ensure that the hat 70 retains its shape.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hat case assembly configured to receive a hat for storage and travel purposes, said hat case assembly comprising:

a housing having a bottom wall and a perimeter wall being attached to and extending upwardly from said bottom wall, said housing including a divider and a plurality of slots in spaced sets for receiving and securing said divider in a static position within said housing corresponding to a selectable one of said spaced sets of slots to divide said housing into a first section and a second section, said housing further including a handle, wheels, and feet;

a cover being pivotally coupled to said perimeter wall of said housing, said cover being positioned in an open position exposing an interior of said housing or in a closed position covering the interior of said housing, zippered compartments being positioned on an insider surface and an outside surface of said cover;

a mount being positioned within said housing and being mounted on an interior surface of said bottom wall, said mount being configured to releasably engage a hat and retain said hat on said bottom wall, said mount including;

a base attached to said interior surface, said base having an upper surface and a perimeter surface;

a primary bracket being mounted on said base, said primary bracket being selectively extendable outwardly away from said perimeter surface to engage the hat when said base is extended into said hat, a locking member releasably locking said primary bracket in a selected position, said primary bracket including a first arm and a second arm attached to each other, said first arm being slidably coupled to said base and being slidable in a plane oriented parallel to said bottom wall, said second arm being vertically oriented with respect to said bottom wall, said second arm having an outer face facing away from said base, said outer face being convexly arcuate, said second arm having a proximal edge with respect to said bottom wall, a lip being attached to said proximal edge, said locking member engaging said first arm; and a secondary bracket being mounted on said base, said secondary bracket being selectively extendable outwardly away from said perimeter surface to engage the hat in a direction opposite of said primary bracket, a securing member releasably locking said secondary bracket in a selected position, said secondary bracket including a first leg and a second leg attached to each other, said first leg being slidably coupled to said base and being slidable in a plane oriented parallel to said bottom wall, said second leg being vertically oriented with respect to said bottom wall, said second leg having an exterior face facing away from said base, said exterior face being convexly arcuate, said second leg having an adjacent edge with respect to said bottom wall, a flange being attached to said adjacent edge, said securing member extending through said first leg.

* * * * *